United States Patent [19]

Ayon et al.

[11] Patent Number: 4,815,999

[45] Date of Patent: Mar. 28, 1989

[54] INSULATED CONTAINER HAVING A THREE-DIMENSIONAL EXTERIOR CARICATURE

[75] Inventors: Lance C. Ayon, Mission Hills; Steven B. Lipman, Sherman Oaks, both of Calif.

[73] Assignee: Puppet Kooler Industries, Inc., Sherman Oaks, Calif.

[21] Appl. No.: 129,836

[22] Filed: Dec. 8, 1987

[51] Int. Cl.[4] ..... A63H 3/00; A47J 41/00

[52] U.S. Cl. ..... 446/73; 206/457; 215/13.1

[58] Field of Search ..... 446/73, 72, 71, 74, 446/76, 77, 268; 215/13.1, 12.1; 206/818, 457

[56] References Cited

U.S. PATENT DOCUMENTS

| | | | |
|---|---|---|---|
| D. 123,218 | 10/1940 | Stavenhagen | 206/457 X |
| 934,344 | 9/1909 | Parker | 215/12.1 |
| 1,949,677 | 3/1934 | Crawford | 215/12.1 X |
| 2,409,820 | 10/1946 | Zimmern | 215/12.1 |
| 2,484,776 | 10/1949 | Zent et al. | 446/73 X |
| 2,994,448 | 8/1961 | Sepe et al. | 215/12.1 X |
| 3,521,397 | 7/1970 | Meates | 446/76 X |
| 3,961,721 | 6/1976 | Gordon et al. | 206/818 X |
| 4,164,284 | 8/1979 | Witt et al. | 215/13.1 X |
| 4,383,422 | 5/1983 | Gordon et al. | 215/13.1 X |

FOREIGN PATENT DOCUMENTS

| | | | |
|---|---|---|---|
| 2112166 | 10/1972 | Fed. Rep. of Germany | 206/457 |

*Primary Examiner*—Mickey Yu

*Attorney, Agent, or Firm*—Allan M. Shapiro

[57] ABSTRACT

Puppet has a combined torso-head which has recess therein for receiving a beverage container. The puppet torso is insulated or has chilled gel therein to cool the container. The exterior of the container is in the form of a three-dimensional caricature including face and torso. The torso carries arms, legs and face, while the hat is the cover for the recess.

6 Claims, 1 Drawing Sheet

32
36
12
22
58
10
50
54
38
16
18
34
30
52
60
56
3
20
24
14
26
42
46
48
28
40
44
62

INSULATED CONTAINER HAVING A THREE-DIMENSIONAL EXTERIOR CARICATURE

FIELD OF THE INVENTION

This invention is in the field of insulated or chilling receivers of beverage containers, and the present receiver is in the form of a puppet-like character which has a three-dimension exterior caricature with a recess in the torso to receive the beverage container.

BACKGROUND OF THE INVENTION

Many beverages are supplied to the public in thin-wall aluminum cans. The can-manufacturing techniques is sufficiently sophisticated so that the bottom and side walls of the can are formed in one-piece, very thin aluminum. Such a container is a low-cost item, and thus is widely used. Such containers are most often used to contain beverages which are conventionally chilled for use. However, aluminum is a highly thermally conductive material so that, when the chilled container is held in the hand, the hand is chilled and the beverage is warmed. In order to extend the time period at which the beverage remains chilled, it is beneficial to provide an insulation therebetween.

Insulated beverage container holders are known. They are sometimes cup-shaped, sometimes in the form of sleeves, and are usually made of foamed synthetic polymer composition material. Such devices have utility, but do not maximize the time potential for holding the beverage container in chilled condition and do not maximize the appearance effect one can obtain by suitable design and decor.

SUMMARY OF THE INVENTION

In order to aid in the understanding of this invention, it can be stated in essentially summary form that it is directed to a puppet-like character having a torso with the torso having a recess therein sized to receive a beverage container with the top of the beverage container extending up out of the recess and torso sufficiently high so that the user may drink from the beverage container. A hat-like cover swings down over the top of the container to insulate the container when access to the container is not required. A face, arms and legs are preferably attached to the torso for creating the puppet-like appearance. A carrying handle is attached to the torso for carrying the torso in puppet-like fashion.

It is thus an object and advantage of this invention to provide a puppet which has an insulated recess for receiving a beverage container so that the beverage container can be protected and maintained chilled while in a decorative enclosure.

It is another object and advantage of this invention to provide a puppet having a torso with a thermal material carrier therein, with a recess in the carrier for receiving the beverage container, the carrier having material therein for insulating and/or chilling the beverage container.

It is another object and advantage of this invention to provide a puppet which has a hat hinged thereon with the hat movable to a closed position where it encloses the extended top of a beverage container and to an open position wherein the user can drink from the beverage container.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figures 1, 2, 3:
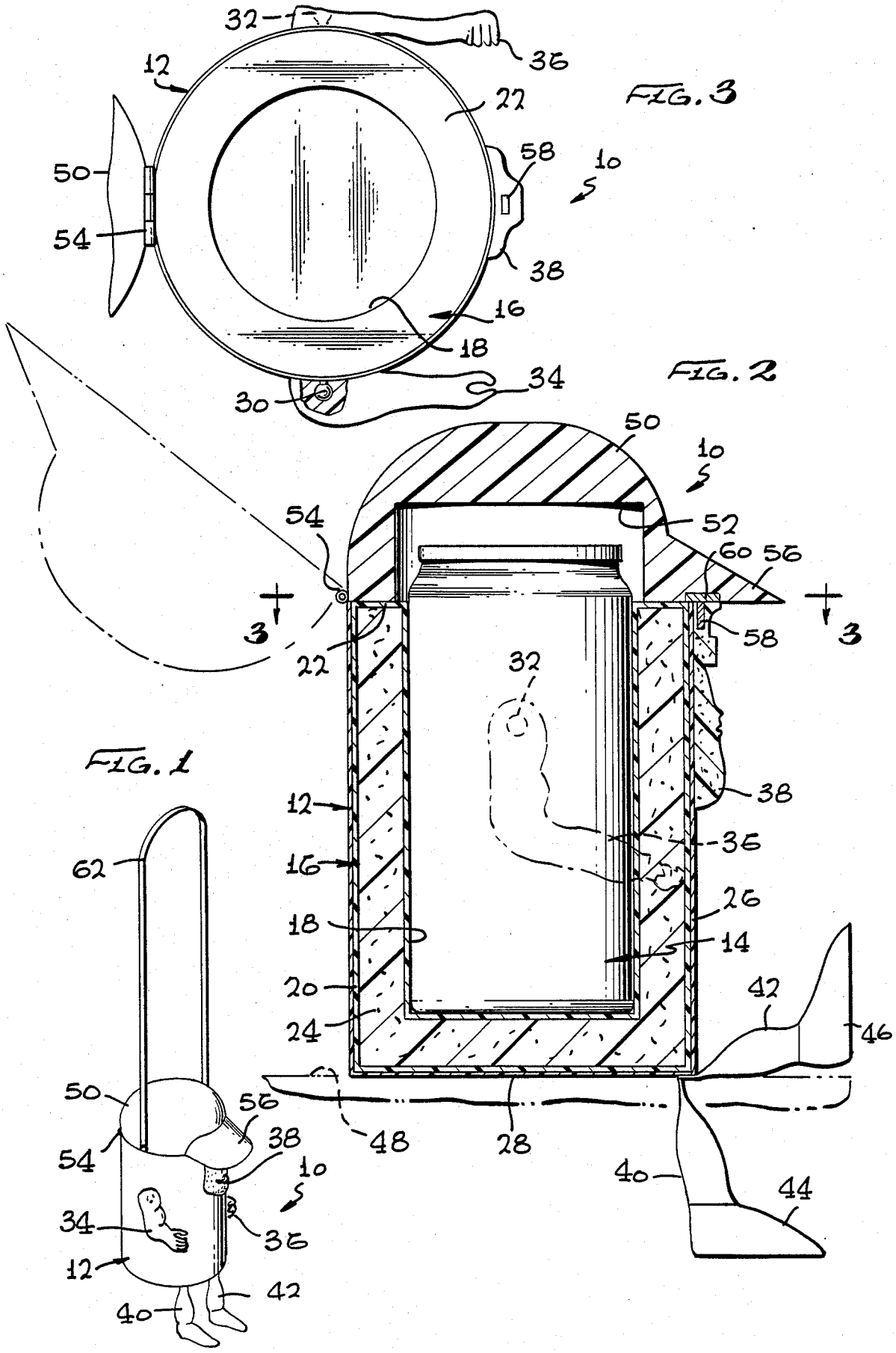
FIG. 1 is an isometric view of the puppet with insulated recess in accordance with this invention.
FIG. 2 is an enlarged vertical section therethrough showing a beverage container in place therein.
FIG. 3 is a plan view thereof, with the top open.

The puppet of this invention is generally indicated at 10 in FIGS. 1, 2 and 3. The puppet has a torso 12 which has a recess therein for receiving beverage can 14, of conventional construction, as seen in FIG. 2.

Torso 12 comprises a double-walled thermal unit 16. The thermal unit 16 has an inner cup 18 which is sized to receive the beverage can 14 and has an outer cup 20. Both cups have closed bottoms and cylindrical side walls. The cups are attached together at the top by means of flange 22 to define closed thermal space 24 between the cups. The thermal space is filled with a thermal insulator material or with a thermal gel which can be first chilled in a freezer and thereafter receive heat from the beverage can 14. The material in the thermal space in the thermal unit is then maintaining the temperature in the beverage can above or preferably below ambient temperature. The thermal unit serves as the strength member of the torso. The thermal unit has sufficient strength to maintain the recess for the beverage can, even when the beverage can is in place. Furthermore, the outer cup of the thermal unit is sufficiently strong to define the outer shape of the torso.

Shell 26 embraces the outer cup of the thermal unit. The shell may have a bottom 28, as shown, which extends under the bottom of the outer cup 20. The purpose of the shell is to provide the exterior color and configuration of the torso and attachment for torso features. The attachments include balls 30 and 32, see FIG. 3, which are fastened on the lateral sides of the shell or are integrally formed therewith. Respectively snapped onto the balls are arms 34 and 36 which have sockets therein which snap over the balls. The arms are thus rotatable on the torso, but the ball and socket joints are sufficiently tight that the arms will stay in the position where they are left. The arms are slightly bent, as seen in FIGS. 1 and 2. Secured to or formed with shell 26 is face 38. The face is a 3-dimensional figure and is positioned on what is defined as the front of the torso.

Legs 40 and 42 are formed of cloth or other flexible material and have hard boots 44 and 46 respectively secured thereon. The legs are attached to the bottom 28 on opposite sides of the front medial line, as shown in FIG. 1. The flexibility of the legs permits them to hang straight, as shown in FIG. 1, or to swing upward above the plane of bottom 28 when the puppet is placed on a flat surface. In FIG. 2, the puppet is shown as being placed partially on table top 48 so that leg 42 is supported thereon and leg 40 hangs dependent over the edge thereof.

Cap 50 is in the form of a cover which swings down and encloses and covers that portion of the beverage container which extends above flange 22. Recess 52 in the cap is sufficiently large to receive the upper portion of the can. The cap is preferably made of thermally insulative material so as to protect the top of the can from heat transfer to the ambient environment. Cap 50 swings open on hinge 54, with a portion of the hinge formed with the upper back of shell 26 and a portion formed with the lower back edge of the cap. The cap hinges sufficiently far away so that the user can have drinking access to the top of the beverage container. Cap 50 is also a cap in the sense of a head covering for the puppet and has visor 56 which extends over the face 38 when the cap is closed. Magnet 58 is positioned in the top of the face just below visor 56 and iron 60 is positioned above the magnet and in close association thereto when the cap is in the closed position shown in FIG. 2.

Puppet 10 is also provided with handle 62. Handle 62 is a continuous loop of flexible material, such as cord, or a strap of polymer composition material. The ends of the loop are secured to opposite upper lateral sides of the shell above the arms. In this way, the puppet can be carried. The use of a magnet-iron combination to hold the cap in the closed position is important with the handle is used for carrying. The cap does not unexpectedly flop open, and thus any potentially spilling beverage is constrained. Furthermore, the holding of the top closed protects the beverage container from heat during carrying.

The torso is large compared to the size of the face, arms and legs to provide a caricature of the figure. The physiognomy is such that it may be a caricature of a famous character so that endorsements may be obtained. The puppet 10 is thus a puppet-like character of humorous and attractive configuration. The puppet may be carried and energized by motion of its handle 62. It may be placed to rest on a flat surface with neither, one or both of its legs hanging down over the edge of the surface to enhance the 3-dimensional puppet configuration, beyond the generally cylindrical shape of the torso. The arms may be rotated to the desired position to give the effect required. In this way, a puppet is created which has the function of receiving a beverage container and protecting the beverage container against the exterior thermal environment.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An insulated container comprising:

a torso having an exterior surface, a three-dimensional caricature of a face mounted on said torso, walls within said torso defining a recess in said torso sized to receive a beverage container, said recess being of such depth that a beverage container therein extends out of said torso, thermal insulation means between said exterior surface and said walls defining said recess for controlling heat flow with respect to a beverage container within said recess;

a removable cover mounted on said torso, said cover being in the form of a hat, having a visor which extends over said face when said cover is in covering position so that said visor can be engaged to open said cover, a hinge fastened to said cover opposite said visor fastened to said torso opposite said face on said torso, said cover having walls defining a recess therein to cover the portion of a beverage container extending upward out of said torso when said cover is in covering position so that said visor can be engaged to open said cover to permit access to the portion of the beverage container extending out of said recess of said torso;

three-dimensional puppet features in addition to said face secured to said exterior surface of said torso, said puppet features being selected from the group consisting of: arms and legs.

2. The puppet of claim 1 further including a magnet piece and a magnetic piece, one of said pieces being secured to said torso and one of said pieces being secured to said cover and being positioned so that when said cover is in closed position, said pieces lie adjacent each other.

3. A puppet shaped insulated container comprising:

a torso having an exterior surface and a bottom, walls defining a recess within said torso with a thermal space between said walls and said exterior surface of said torso, a thermal material in said thermal space, said recess being sized so that when a beverage container is placed therein, the beverage container extends sufficiently far above said torso so that the user may drink therefrom without removing the beverage container from the torso;

a cover, said cover having walls therein defining a recess which engages over that portion of the beverage container which extends above said torso when said cover is in covering position, said cover being in the form of a cap having a visor, a hinge connected to both said torso and said cover so that said cover is hingedly movable from an open position to a covering position;

a three-dimensional face on said exterior surface of said torso, said cover being configured so that said visor overlaps said face when said cover is in closed position;

first and second legs flexibly mounted on said torso adjacent said bottom thereof, said legs being fastened to said torso substantially below said face, said legs at least partially being made of fabric so that fabric flexure permits said legs to hang down when they are unsupported and permits said legs to swing up above the plane of said bottom when said bottom is resting on a support surface, a boot secured to the terminal end of each of said legs away from said torso;

first and second arms fastened to said torso on the lateral sides of said torso with respect to said face, each of said arms having a ball and socket connection with respect to said torso so that each of said arms can be moved; and a flexible handle mounted on said torso so that said puppet can be carried with legs depending and said puppet can be jiggled by motion of said handle.

4. The puppet of claim 3 further including a magnet piece and a magnetic with one of said pieces secured to said torso and one of said pieces secured to said cap that when in the covering position said pieces lie adjacent each other to magnetically restrain said cover in the covering position.

5. A puppet shaped insulated container comprising:

a torso having an exterior surface and a bottom, walls defining a recess within said torso with a thermal space between said walls and said exterior surface of said torso, a thermal material in said thermal space, said recess being sized so that when a beverage container is placed therein, the beverage container extends sufficiently far above said torso so that the user may drink therefrom without removing the beverage container from said torso;

a cover, said cover having walls therein defining a recess which engages over that portion of the beverage container which extends above said torso when said cover is in covering position, said cover being in the form of a cap having a visor, said cover being movable from an open position to said covering position;

a three-dimensional face on said exterior surface of said torso, said cover being configured so that said visor overlaps said face when said cover is in closed position;

first and second legs flexibly mounted on said torso adjacent said bottom thereof, said legs being fastened to said torso substantially below said face, said legs at least partially being made of fabric so that fabric flexure permits said legs to hang down when they are unsupported and permits said legs to swing up above the plane of said bottom when said bottom is resting on a support surface, a boot secured to the terminal end of each of said legs away from said torso;

first and second arms fastened to said torso on the lateral sides of said torso with respect to said face, each of said arms having a ball and socket connection with respect to said torso so that each of said arms can be moved; and a flexible handle mounted on said torso so that said puppet can be carried with legs depending and said puppet can be jiggled by motion of said handle.

6. The puppet of claim 5 including a magnet piece and a magnetic piece with one of said pieces secured to said torso and one of said pieces secured to said cover so that when in the covering position said pieces lie adjacent each other to magnetically restrain said cover in the covering position.

* * * * *